US005421111A

United States Patent [19]

Primm et al.

[11] Patent Number: 5,421,111

[45] Date of Patent: Jun. 6, 1995

[54] STORAGE AND FRAMING UNIT FOR A VARIETY OF PHOTOGRAPHIC SIZES

[76] Inventors: Ronald J. Primm, 609 Stockley Galas, Norfolk, Va. 23507; Christian Primm, 119 W. Belvedere Rd., Norfolk, Va. 23505

[21] Appl. No.: 129,420

[22] Filed: Sep. 30, 1993

[51] Int. Cl.[6] ..... B44C 5/02

[52] U.S. Cl. ..... 40/158.1; 40/152.1; 40/152

[58] Field of Search ..... 40/152, 152.1, 155, 40/156, 158.1, 154

[56] References Cited

U.S. PATENT DOCUMENTS

| | | | |
|---|---|---|---|
| 2,166,641 | 7/1939 | Perera et al. . | |
| 3,782,015 | 1/1974 | Esry . | |
| 3,787,992 | 1/1974 | Leonhardt | 40/152 |
| 4,483,085 | 11/1984 | Barton . | |
| 4,691,456 | 9/1987 | Ackeret . | |
| 4,852,281 | 8/1989 | Blome et al. . | |
| 4,870,765 | 10/1989 | McLeod | 40/152 |
| 4,998,361 | 3/1991 | Gordon . | |
| 5,038,935 | 8/1991 | Wenkman et al. . | |
| 5,247,744 | 9/1993 | Ferris et al. | 40/152 |

FOREIGN PATENT DOCUMENTS

| | | | |
|---|---|---|---|
| 705420 | 6/1931 | France | 40/152 |
| 736949 | 7/1943 | Germany | 40/158.1 |
| 251337 | 10/1947 | Switzerland | 40/152 |

*Primary Examiner*—Brian K. Green
*Attorney, Agent, or Firm*—Robert E. Bushnell

[57] ABSTRACT

An improved photograph display and storage device for mounting and displaying a photograph of various sizes and additionally storing a plurality of negatives and other mounted, bound, unmounted or unbound photographs of various and differing sizes. The device utilizes an insert, which supports the displayed photograph and accommodates a plurality of stored photographs. A slidable transparent window permits the displayed photograph to be easily changed. A photo mat having a plurality of different sized openings may be used to attractively display a variety of different sized photographs. The device may lay flat upon any supporting surface, be detachably secured to a stand in a rearwardly tilted direction, or hung on a vertical surface to provide an eye pleasing effect for the displayed photograph.

25 Claims, 10 Drawing Sheets

STORAGE AND FRAMING UNIT FOR A VARIETY OF PHOTOGRAPHIC SIZES

BACKGROUND

1. Field of Invention

The invention relates to the storing and displaying of photographs in a variety of sizes in a new and improved method.

2. Description of Prior Art

The prior art consist of a variety of methods of storing photographs behind a display window. These methods limit the user to a one size photograph for display purposes. In order to display photographs of different sizes, a multiple of photograph display units must be used. Also lacking is the ability to adapt the display feature "framing" to a particular type of photograph, light vs. dark or color, without acquiring a second photograph display/storage unit.

One such photograph display/storage unit, U.S. Pat. No. 4,691,456 to Ackeret (1987), demonstrates several of the problems identified above. The user of this unit must use only one size photograph for displaying through the window or storing within the unit. For example, a unit designed for a standard 8.89 cm×12.7 cm (3½"×5") photograph will not allow for a standard 10.16 cm×15.24 cm (4"×6") photograph to be stored or displayed in the same unit. Another problem is that once the user obtains the unit he/she will not be able to change the outward appearance of the unit to accommodate different types of photographs. For example, if the unit has a black border "frame" it would be difficult to get the desired visual effect with a dark photo.

Other prior art, U.S. Pat. Nos. 3,557,480 to Ebner (1971); 3,782,015 to Esry (1974); 4,483,085 to Barton (1984); 4,998,361 to Gordon (1991) & 5,038,935 to Wenkman et al. (1991), all demonstrate the above identified problems. None of these photo display/storage devises has the versatility to display different size photos or the ability to adapt the display feature "framing" to a particular type or color of photograph.

The prior art also consist of labor intensive methods of manufacturing, often consisting of hinges, springs, or a box like container inside of another box like container. Examples of this are U.S. Pat. No. 4,691,456 to Ackeret (1987), 4,483,085 to Barton (1984), and 5,038,935 to Wenkman et al. (1991). Several embodiments of containers disclosed in these patents have a tensioning device, comprising a spring system or other mechanical means for adapting the container to hold stacks of different numbers of pictures. Frequently, the outer container members, such as the housing, lid, and window, are made of plastic while the mechanical systems are made of metal or a metallic/plastic combination. As a matter of economics, these materials require different methods of manufacture. The metal parts must then be assembled with the plastic members in a separate manufacturing step. Such assembly is relatively expensive.

OBJECTS AND ADVANTAGES

Accordingly, several objects and advantages of the invention are:

a) to provide an improved method to display photographs of a variety of sizes in a fast and simple way;
b) to provide an improved method to store photographs of varying sizes in one standard-sized unit;

c) to provide a cost effective method of displaying and storing photographs within a single unit;
d) to provide a method of easy entry to the storage area for a quick change to display a desired photograph;
e) to provide for storage of photographs, whereby quick retrieval of a particular photograph is easy;
f) to provide several methods for displaying the photograph displaying/storage unit;
g) to provide a superior method of displaying different types of photographs, dark vs. light, in a frame to get a desired visual effect, within the same unit;
h) to provide an area whereby negatives can be stored within the unit.

It is the intention of the present inventors to provide a new and improved method of displaying and storing photographs within an single unit, without the waste of complicated and expensive manufacturing process. Further objects and advantages of the invention will become apparent from a consideration of the drawings and ensuing description.

DRAWING FIGURES

In the drawings, closely related figures have the same number but different alphabetic suffixes.

| | |
|---|---|
| 10) Framing Unit | 12) Transparent display window |
| 14) Opening | 16) Groove |
| 18) Bevel | 20) Inward Recess |
| 21) Outer-Most Edge | 22) Locking Tab |
| 23) Slide Handle | 24) Slot(s) |
| 25) Hole(s) | 26) Insert |
| 28) Photo Mat | 30) Small Cut Out |
| 31) Large Cut Out | 32) Folds |
| 34) Cut | 36) Section A |
| 38) Section B | 40) Section C |
| 42) Photograph(s) | 44) Stand |

DESCRIPTION—FIGS. 1 TO 6

Figure 1:
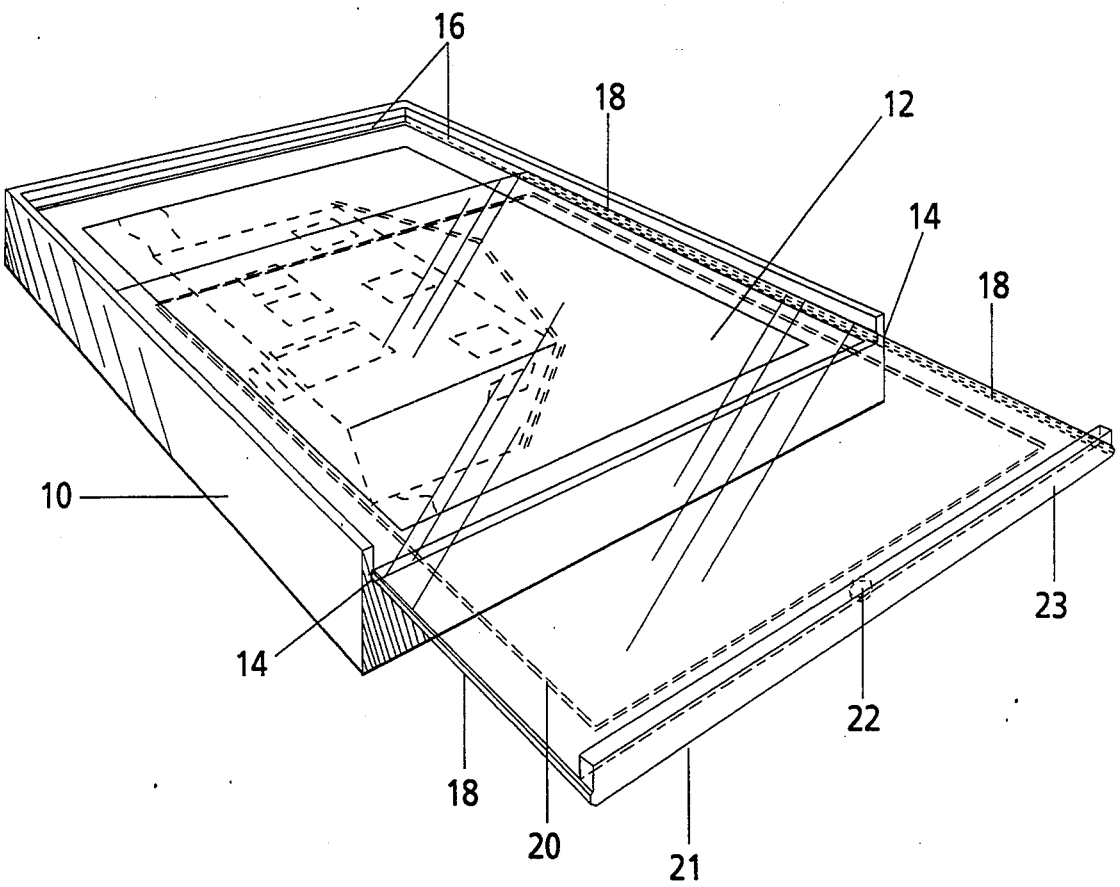
FIG. 1 shows a perspective view of a framing unit with a transparent display window partially open with a photograph and photo mat in place.
Figure 2:
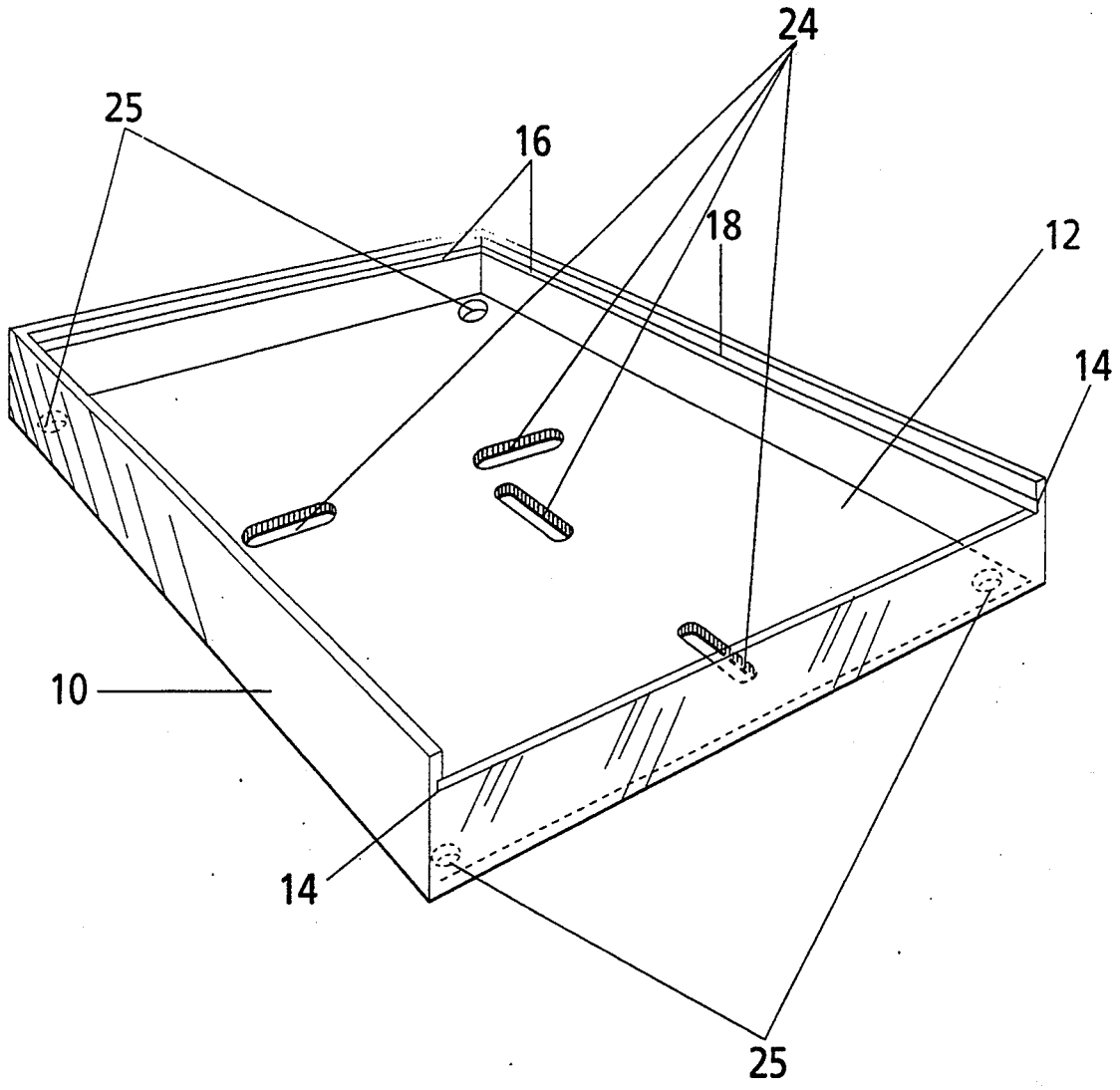
FIG. 2 shows a perspective view of the framing unit of FIG. 1 without the transparent window.

Referring now to the drawings, wherein like reference numerals designate like or corresponding parts throughout the several views, there is shown in FIG. 1 a preferred embodiment of a photograph display and storage device framing unit 10. More specifically, framing unit 10 is made up of four walls, preferably composed of a polymeric compound, consisting of two sides and two ends, one end being shorter than the other, and a bottom, with the top open. Located on the inside of the walls of equal height is a groove 16. Located on a shorter end wall is an opening 14. Groove 16 and opening 14 will have sufficient clearance to accept a transparent display window 12, which slides inward and outward. FIG. 2 shows a placement of slots 24, located in the bottom wall of framing unit 10. A combination of center slots 24 can be used with a stand 44 to be demonstrated later in this description. A second set of four holes 25 are located in the corners, one in each corner. Holes 25 can be used to hang-up a framing unit 10 on a wall with a pair of nails. The placement of holes 25 allow framing unit 10 to be hung vertically or horizontally. Also shown in FIG. 2 is an end wall that has opening 14.

Figure 3:
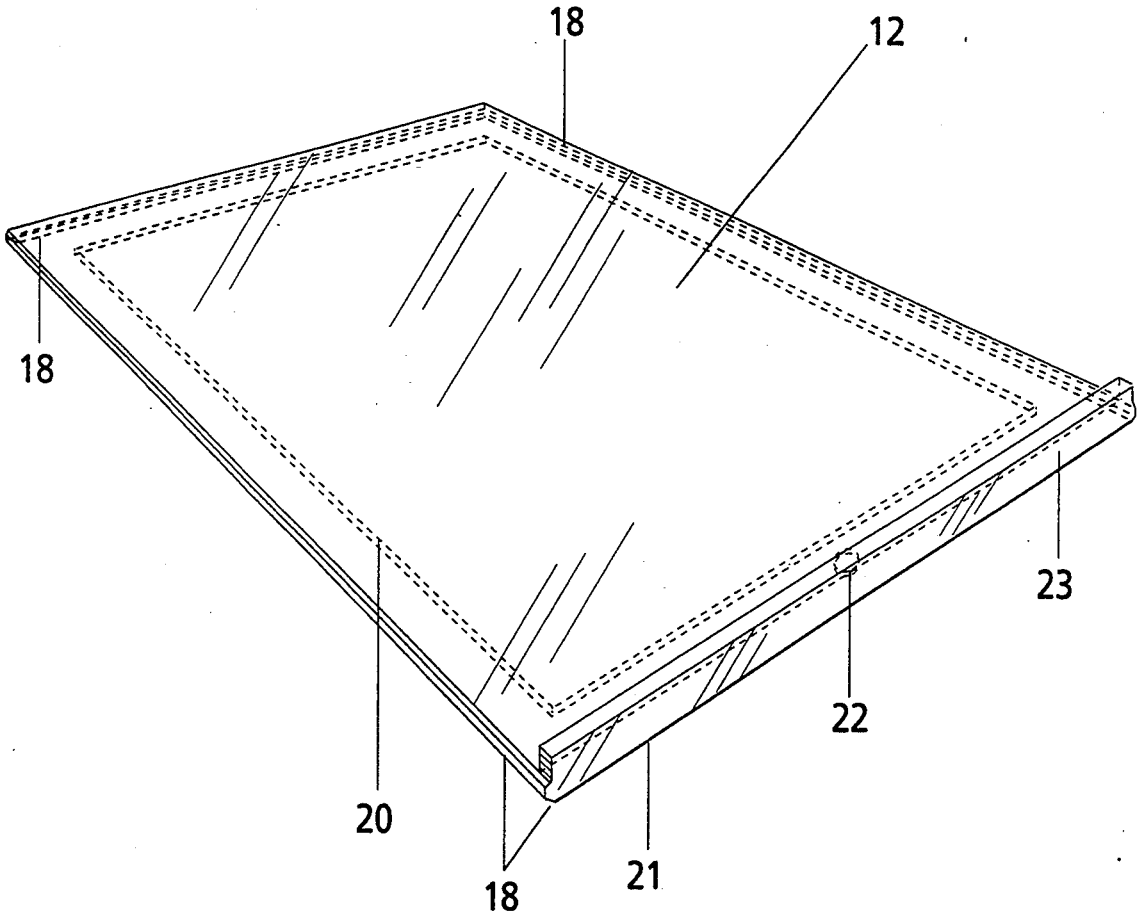
FIG. 3 shows a perspective view of the transparent display window of FIG. 1.

FIG. 3 shows a perspective view of transparent display window 12. Three of the four sides have a beveled edge 18 to ensure smooth sliding of transparent display window 12 within groove 16, as shown on FIG. 1. The fourth edge is cut square with a locking tab 22 in the center and a slide handle 23 that matches the difference in height between the shorter and the higher end walls. An inward recess 20, consisting of an area that encompasses all but an outer most edge 21 and bevels 18, is required to prevent scratching.

Figure 4:
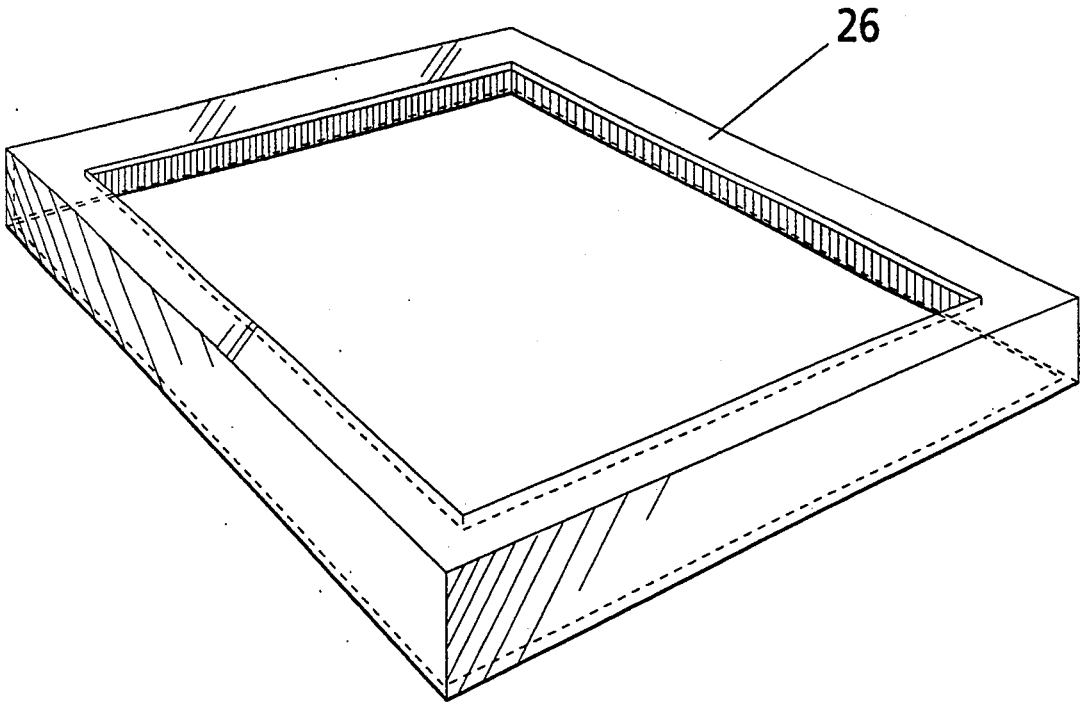
FIG. 4 shows a perspective view of an insert.
Figure 5A:
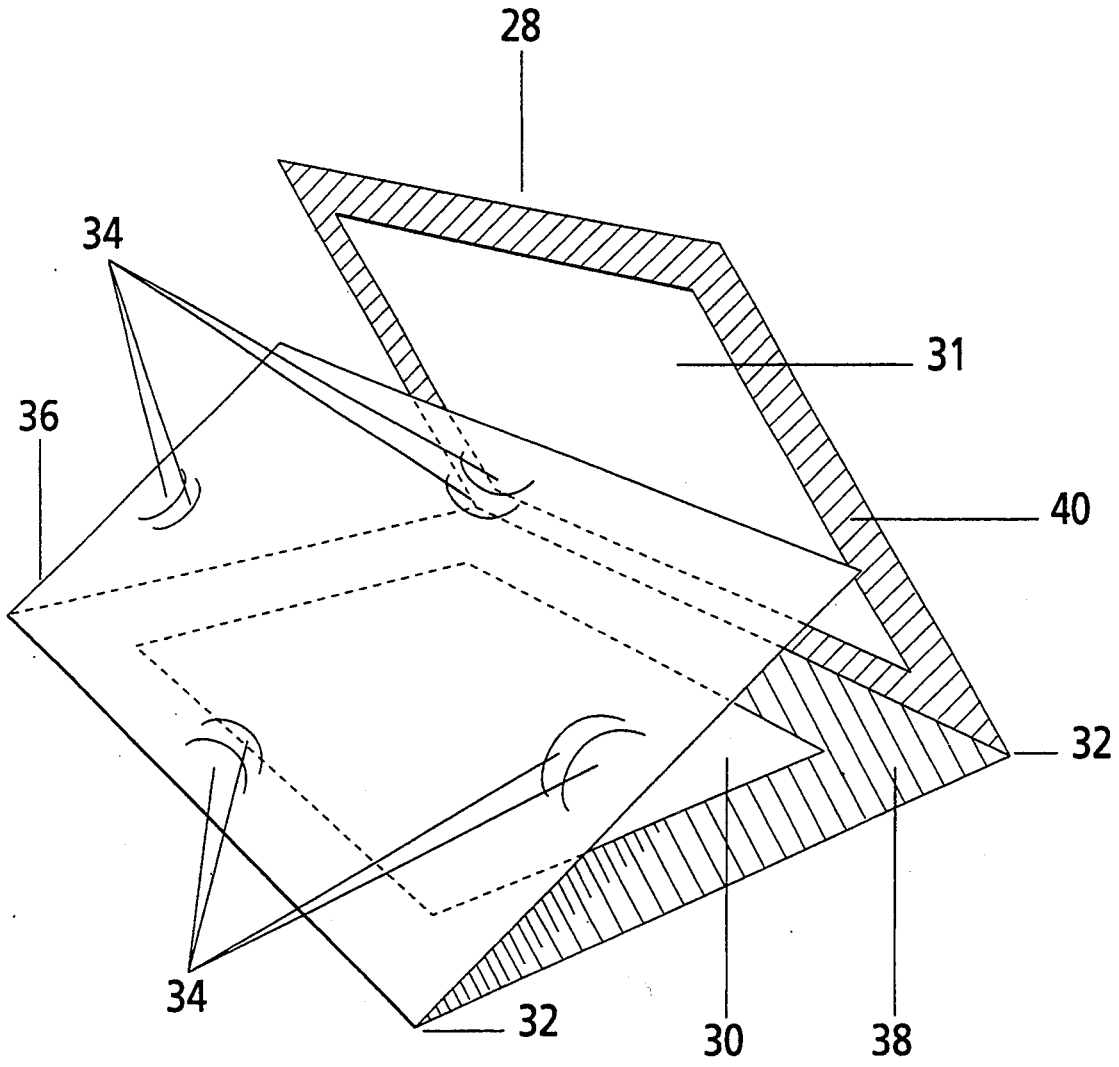
FIGS. 5A–5D shows various aspects of a photo mat in use.
Figure 5B:
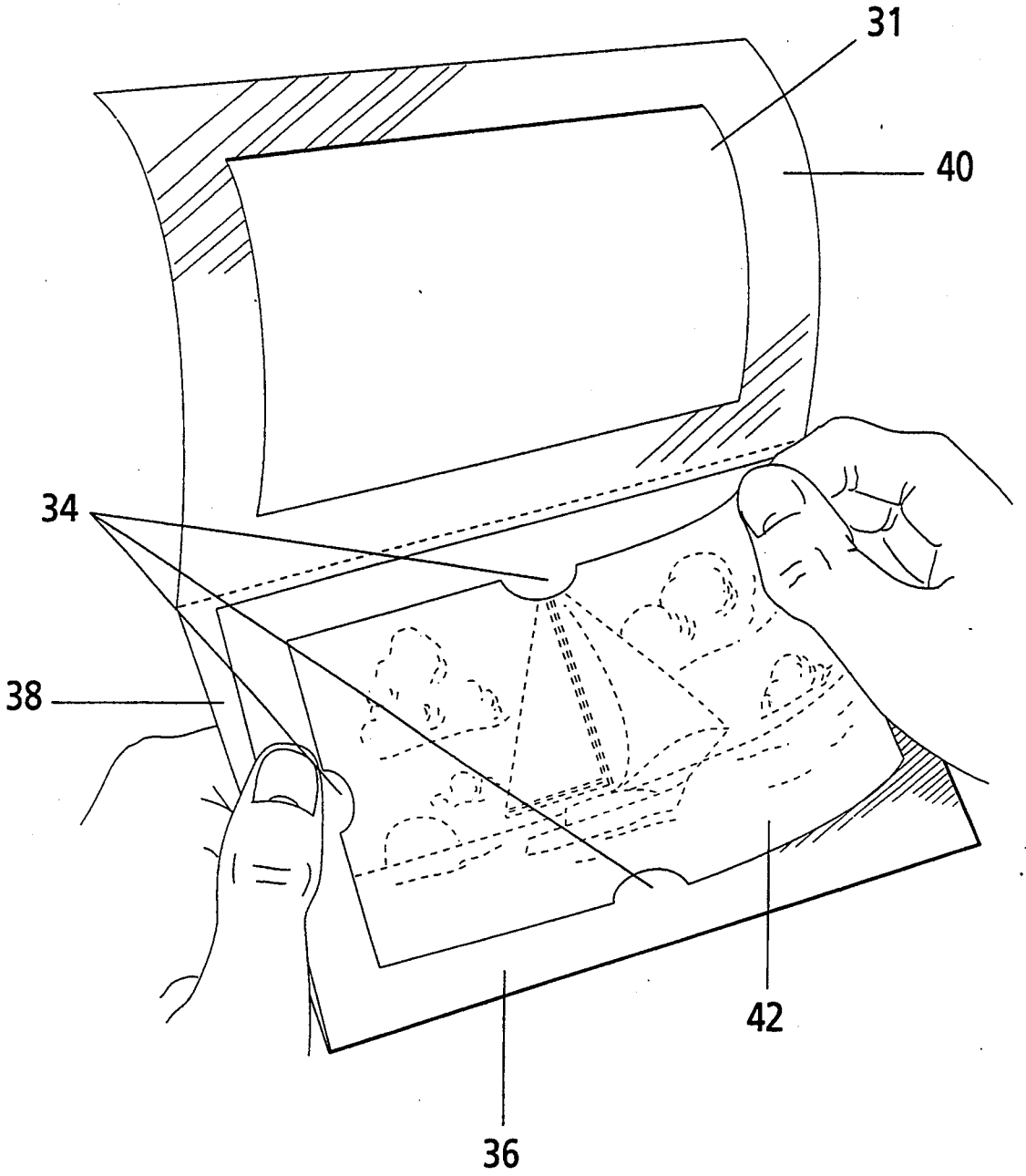
Figure 5C:
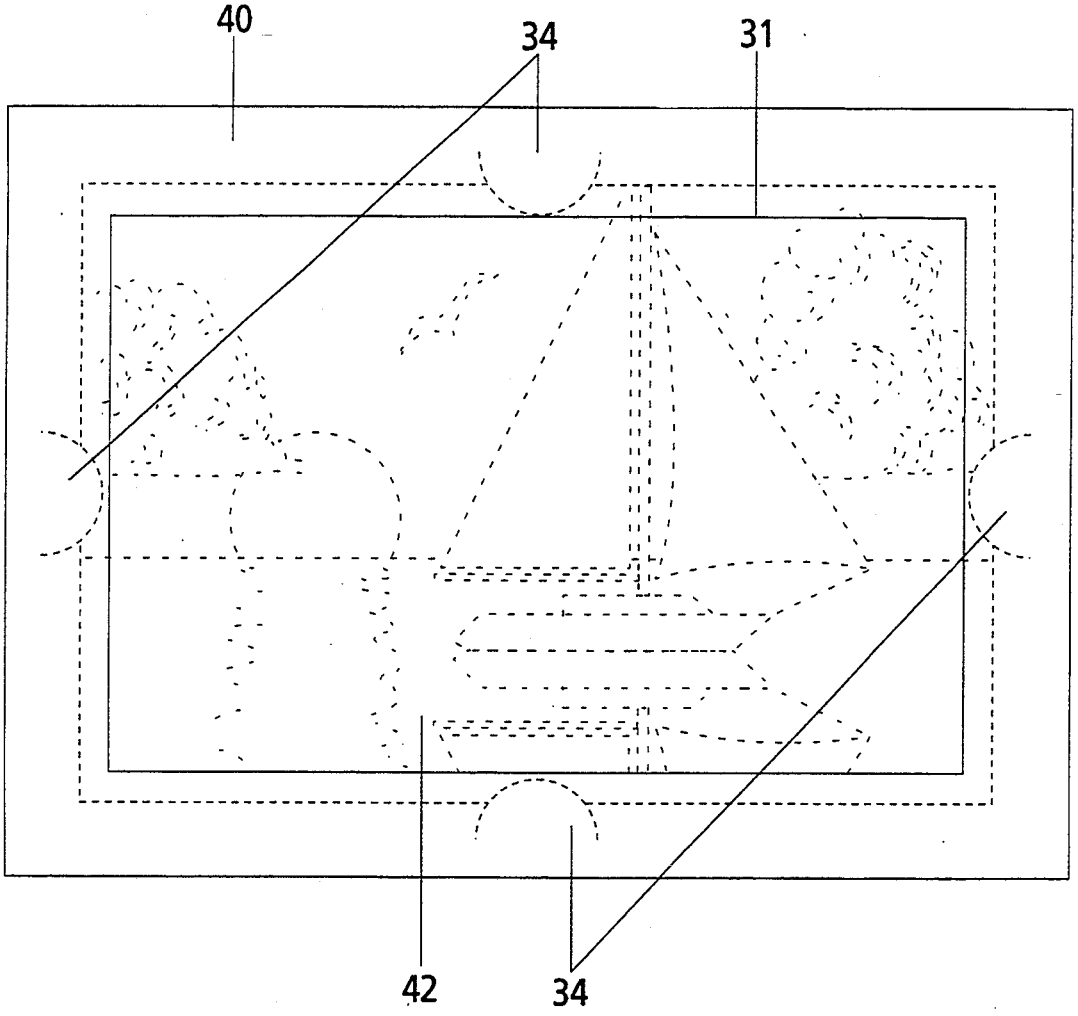
Figure 5D:
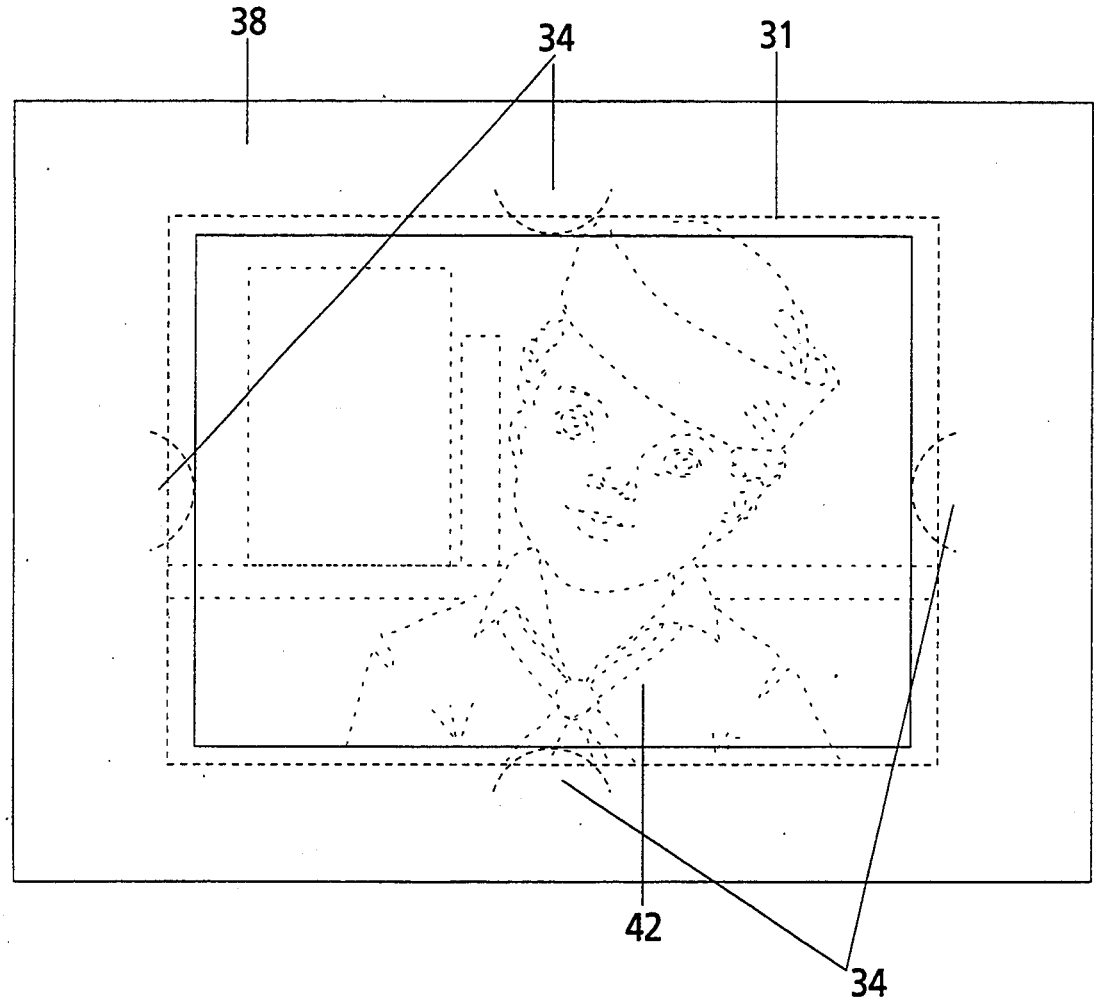

FIG. 4 shows a perspective view of an insert 26. Insert 26 consists of a rectangular "frame-like" structure with a continuous support. The center of insert 26 is hollow. The purpose of insert 26 is to support either a displayed photograph or the outer edges of a photo mat 28, shown in FIGS. 5A to 5D. Photo mat 28 is made of a firm acid free paper with one side consisting of a visually desired color and texture. Photo mat 28 will be visible through transparent display window 12, and will become the border to a photograph. As shown on FIG. 5A, photo mat 28 has a two display border sectons 38 and 40 formed by a small cut-out 30 and a large cut-out 31. Cut-out 31, as illustrated, will be larger in section 40, than a cut-out 30 in section 38. Section 36 is a smaller photograph mounting section, which consists of a flat surface containing a series of cuts 34 for retaining photographs of differing sizes. Dividing each section is a fold 32. FIG. 5B illustrates how a photograph 42 is to be inserted into a cut 34, in section 36. Depending on the size of the photograph, a user can insert a photograph on either side of section 36 to obtain a desired border. If the photograph is larger, the user would fold section 36 onto section 38, and insert the photograph. Then he/she would fold section 40 onto section 36, thus having the photograph displayed through the large cut-out 31, producing a visual effect as demonstrated on FIG. 5C. If the user has a smaller photograph, he/she would insert it on the other side of section 6, fold section 36 onto section 40. The section 38 is folded onto section 36, thus having the photograph displayed through small cut-out 30, producing a visual effect as demonstrated on FIG. 5D.

Figure 6:
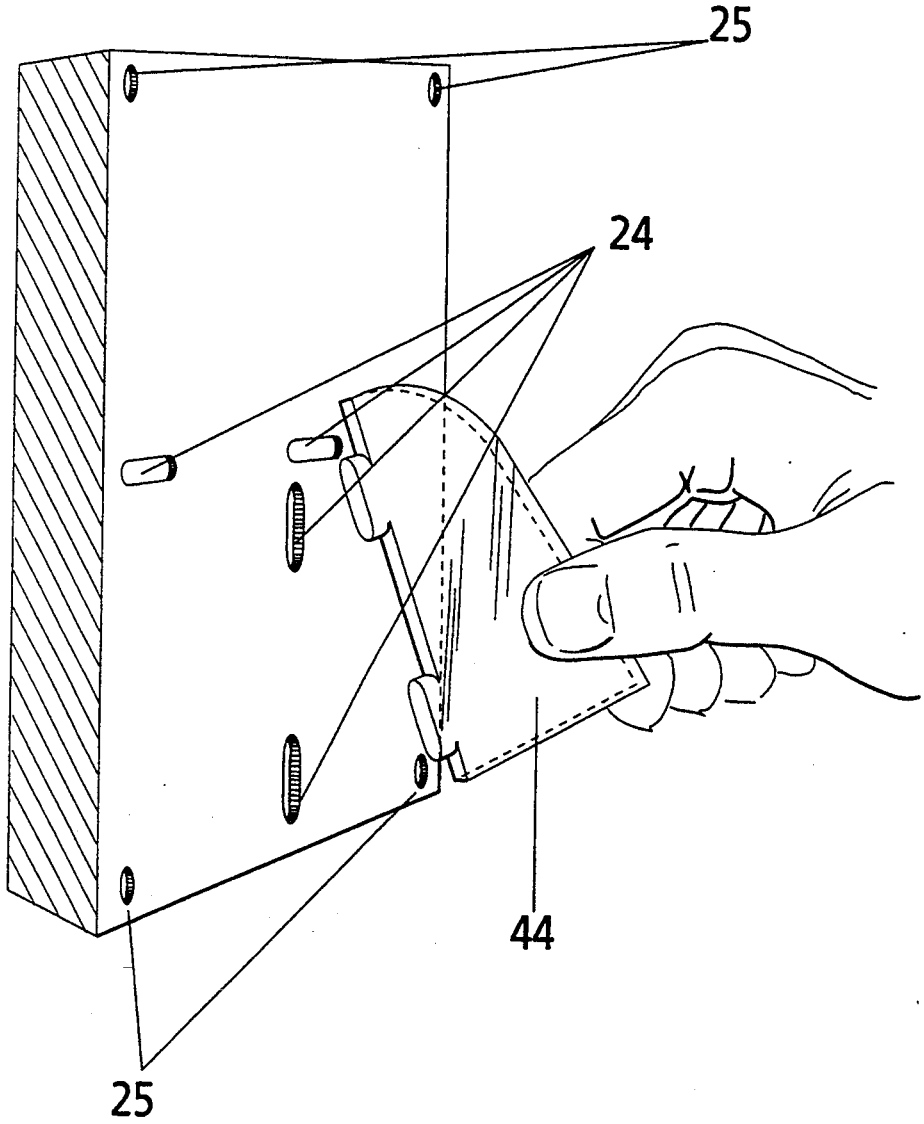
FIG. 6 shows a stand in use.

In FIG. 6, the stand 44 is inserted into slots 24 in the back of framing unit 10. Slots 24 are positioned to allow the user to display his/her framing unit 10 in either a horizontal or vertical position. When stand 44 is not in use, it can be stored inside framing unit 10. Framing unit 10 can be viewed in a variety of methods. For example, framing unit 10 can be hung on the wall using holes 25, as illustrated in FIG. 2, or it can use stand 44, or it can be stood on one of it's sides, end walls or bottom. All of the above viewing methods can be utilized in both a vertical or horizontal position.

From the description above, a number of advantages of our storage/framing unit become evident:

(a) The ability to display photographs of a variety of sizes within one standard-sized unit in a fast and simple way will obviate the need for frames of a multiple of sizes.

(b) The ability to store photographs of different and differing sizes and negatives within one standard-sized unit as the displayed photograph provides a cost-effective and organized method to maintain a collection of photographs.

(c) The unit provides a method to display and store photographs of different and differing sizes in a fast and simple way.

(d) The use of the adjustable photo mat in a variety of colors and textures provides a method to display different types of photographs, e.g. dark v. light, within the same unit.

(e) The ability of the unit to be displayed lying flat on any surface, with the stand, or hung on a wall, provides a flexibility of display methods within a single, low-cost unit.

OPERATION—FIG. 7

Figure 7:
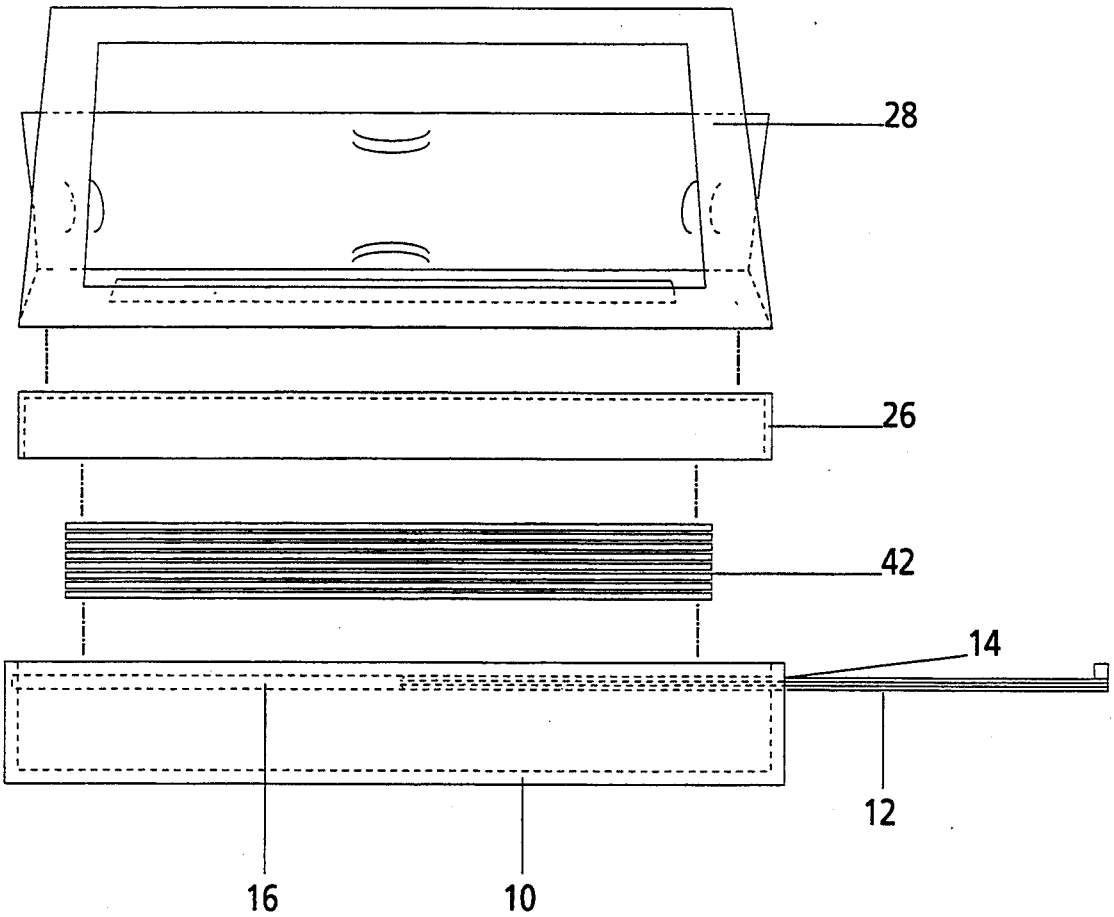
FIG. 7 shows an exploded view of the various parts of the storage and framing unit.

FIG. 7 illustrates an exploded view of a storage/-framing unit. The completed storage/framing unit consists of a framing unit 10, a transparent display window 12, an insert 26, optional photographs 42 for storage, and a photo mat 28. Assembly and use are very basic. Insert 26 is placed into framing unit 10. Photographs 42 that are to be stored will be placed in the hollow area of insert 26, as illustrated. Insert 26 is of sufficient height as to support the photo mat 28 just below groove 16. A photograph is inserted into photo mat 28 of a desired color and texture, as illustrated above in FIGS. 5B to 5D. Photo mat 28 is then placed onto insert 26. If the photograph is of sufficient size, photo mat 28 is not used and the photograph is placed directly onto insert 26 (not shown). Assembly of storage/framing unit is complete when transparent display window 12 is slid through opening 14 along groove 16, and makes contact with the opposite side of framing unit 10, leaving transparent display window 12 flush with the outer end wall of framing unit 10.

SUMMARY, RAMIFICATIONS AND SCOPE

There are numerous variations in which a storage/-photo unit can be used. Options consist of the use of different sized photographs placed in a photo mat, or if the photo is of sufficient size, a user can disregard a photo mat, as to allow the framing unit to become the only border. A series of different visual effects can be utilized by the use of different textures and colors of a photo mat, as noted above. This combination allows the user to change the visual effect produced by a storage/-photo unit, without the expense of acquiring a second unit. Very simply, in order to produce a different visual effect for the same photograph or for a different photograph, the user acquires a different, relatively inexpensive, photo mat of a desired texture and color.

Other variations of this invention include the way a storage/photo unit is displayed. With the use of the stand or the ability to hang the unit on the wall, or, to simply stand or lay the unit on one of its four sides or bottom, allows for a variety of displaying methods. All of the previously mentioned methods of display are enhanced by the versatile means of displaying the storage/display unit in both a horizontal and vertical positions.

Utilizing the various ramifications above makes an unlimited means of displaying a photograph in the storage/framing unit, when one considers the number of different colors, textures, and designs that can be used for a photo mat, along with the various displaying methods.

Although the description above contains many specificities, these should not be construed as limiting the scope of the invention but as to merely providing illustrations of some of the presently preferred embodiments of this invention. For example, the photo/display unit can be utilized as a simple storage device which can be stood upright on a shelf.

Thus the scope of the invention should be determined by the appended claims and their legal equivalents, rather than by the example given.

We claim:

1. A photograph display and storage unit for displaying a single photograph of any one of a variety of sizes and storing a multiple of negatives and photographs of different and differing sizes, comprising:

a rectangular framing unit having two side walls and a first end wall of a first height, a second end wall of a second and lesser height than said first height, and a bottom, a groove formed in said side walls and said first end wall of said framing unit above said second height of said second end wall, transparent window means for slidably opening and closing said framing unit, said transparent window means being of a size to fit inside said groove and substantially flush with an outer surface of said second end wall when closed, a support structure inserted within said framing unit for supporting a photograph near said transparent window means, a photograph mounting and displaying device, supported between said support structure and said transparent window means, and having at least three sections divided by folds, at least two of said sections having cut out areas of predetermined but different sizes and a third said section having manufactured means for holding any of a plurality of different sized photographs.

2. The photograph display and storage unit of claim 1, wherein said framing unit is of an internal size approximately equal to a 12.7 cm×17.78 cm (5"×7") photograph.

3. The photograph display and storage unit of claim 1, wherein said framing unit is comprised of a polymeric compound.

4. The photograph display and storage unit of claim 1, wherein said framing unit is opaque.

5. The photograph display and storage unit of claim 1, wherein said transparent window means has a beveled outer edge accommodating slidable travel in said groove during said opening and closing.

6. The photograph display and storage unit of claim 5, comprising said transparent window means having a recessed portion for protecting the center of said transparent window from scratches while sliding into and out of said groove.

7. The photograph display and storage unit of claim 6, further comprising:

a support stand;

said bottom of said rectangular framing unit bearing a plurality of apertures for receiving and retaining said support stand against said bottom; and said support structure comprising a plurality of connected side walls of an equal predetermined height and a continuous ledge extending along a top edge of said plurality of connected side walls, projecting inwardly, said continuous ledge forming a hollow opening receiving entry of photographs to be stored inside of said support structure.

8. The photograph display and storage unit of claim 1, wherein said support structure has four side walls of an equal predetermined height and a continuous ledge along a top edge of said walls, projecting inwardly.

9. The photograph display and storage unit of claim 8, wherein said support structure is a hollow frame enabling storage of photographs within said framing unit.

10. The photograph display and storage unit of claim 8, wherein said support structure has a hollow opening means for receiving entry of photographs to be stored inside of said support structure.

11. The photograph display and storage unit of claim 1, wherein said photograph mounting and displaying device is comprised of stiff paper.

12. The photograph display and storage unit of claim 1, wherein said photograph mounting and displaying device is comprised of acid-free paper.

13. The photograph display and storage unit of claim 1, wherein said photograph mounting and displaying device is comprised of colored paper.

14. The photograph display and storage unit of claim 1, further comprising a support stand; and said bottom comprising a plurality of apertures for receiving and retaining said support stand against said bottom.

15. The photograph display and storage unit of claim 1, wherein said bottom comprises a plurality of apertures.

16. A photographic print display unit for displaying a single photograph of any one of a variety of sizes, comprising:

a rectangular framing unit having two side walls and a first end wall of a first height, a second end wall of a second and lesser height than said first height, and a bottom, a groove formed in said side walls and said first end wall of said framing unit above said second height of said second end wall, transparent window means for slidably opening and closing said framing unit, said transparent window means being of a size as to fit inside said groove and substantially flush with an outer surface of said second end wall when closed, a support structure inserted within said framing unit for supporting a photograph near said transparent window means, a photograph mounting and displaying device, supported by said support structure, and having at least three sections divided by folds, at least two of said sections having cut out areas of predetermined but different sizes and a third said section having manufactured means for holding any of a plurality of different sized photographs.

17. The photographic print display unit of claim 16, wherein said photograph mounting and displaying device is comprised of stiff paper.

18. The photographic print display unit of claim 16, wherein said photograph mounting and displaying device is comprised of acid-free paper.

19. The photographic print display unit of claim 16, wherein said photograph mounting and displaying device is comprised of colored paper.

20. The photographic print display unit of claim 15, wherein said framing unit is comprised of a polymeric compound.

21. A photograph display and storage device, comprising:

a framing unit defining an open top and forming a bottom wall and a plurality of adjoining side walls extending upwardly from said bottom wall, a shorter wall of said plurality of side walls extending upwardly from said bottom wall to a lesser height than adjoining ends of two of said plurality of side walls, said two of said plurality of side walls having opposed and spaced apart grooves formed at a height above said bottom wall greater than said lesser height of said shorter wall;

a transparent window slidably inserted into said grooves for opening and closing said open top of said flaming unit, said transparent window having a recessed lower surface comprising an area defining an outermost edge of said window for placing said recessed surface spaced apart from said shorter wall while said window is traveling within said grooves;

a support structure, removably inserted within said framing unit, formed by a plurality of inner walls of a lesser height than said shorter wall of said framing unit, for accommodating plurality of stored photographs within said inner walls, said support structure further comprising a continuous ledge extending along a top edge of said inner walls and continuing inwardly from said walls, for supporting display of a photograph immediately below said transparent window, said ledge forming an opening in said support structure accommodating entry of photographs to be placed within said inner walls; and a photo mat, supported by said ledge above said opening in said support structure, and having a plurality of separated closed openings of different sizes for accommodating said display of the photograph having any one of a plurality of different and differing sizes corresponding to different ones of said closed openings..

22. The photograph display and storage device of claim 21, further comprising:

photograph mounting means for retaining the photograph having any one of a plurality of sizes in a fixed position above said opening in said support structure, said ledge of said support structure supporting a periphery of said photograph mounting means.

23. The photograph display and storage device of claim 21, said support structure further comprising said plurality of inner walls defining an outermost perimeter of said support structure, said perimeter having a length greater than a length of a perimeter of said opening, accommodating storage of photographs larger than said opening.

24. A kit, comprising:

a framing unit defining an open top and forming a bottom wall and a plurality of adjoining side walls extending upwardly from said bottom wall, a shorter wall of said plurality of side walls extending upwardly from said bottom wall to a lesser height than adjoining ends of two of said plurality of side walls, said two of said plurality of side walls having opposed and spaced apart grooves formed at a height above said bottom wall greater than said lesser height of said shorter wall;

transparent window means slidably insertable into said grooves for opening and closing said open top of said framing unit, said transparent window means having a recessed lower surface comprising an area defining an outermost edge of said transparent window means for placing said recessed surface spaced apart from said shorter wall while said transparent window means is traveling in said grooves;

a support structure, insertable within said framing unit to a position beneath said grooves, formed by a plurality of inner walls of a lesser height than said shorter wall of said framing unit, for accommodating a plurality of stored photographs within said inner walls, said support structure further comprising a continuous ledge extending along a top edge of said inner walls and continuing inwardly from said walls, said ledge forming an opening in said support structure;

a plurality of display borders removably insertable within said framing unit between said support structure and said transparent window means, each of said display borders providing a different size closed opening; and photograph mounting means, removably insertable within said framing unit, for retaining any one of a plurality of photographs of different and differing sizes in a fixed position beneath one of said display borders and above said opening in said support structure, said ledge of said support structure supporting a periphery of said photograph mounting means.

25. The kit of claim 24, said support structure further comprising said plurality of inner walls defining a perimeter of said support structure, said outermost perimeter having a length greater than a length of a perimeter of said opening, accommodating storage of photographs larger than said opening.

* * * * *